US008230931B2

(12) United States Patent
Rodriguez et al.

(10) Patent No.: US 8,230,931 B2
(45) Date of Patent: Jul. 31, 2012

(54) LIFTING DEVICE AND METHOD FOR LIFTING A BONNET

(75) Inventors: Perrin Rodriguez, Cypress, TX (US); Seferino Rivera, Sugar Land, TX (US)

(73) Assignee: Hydril USA Manufacturing LLC, Houston, TX (US)

( * ) Notice: Subject to any disclaimer, the term of this patent is extended or adjusted under 35 U.S.C. 154(b) by 400 days.

(21) Appl. No.: 12/648,509

(22) Filed: Dec. 29, 2009

(65) Prior Publication Data

US 2011/0155394 A1 Jun. 30, 2011

(51) Int. Cl.
*E21B 23/00* (2006.01)
*E21B 33/06* (2006.01)
*B66F 19/00* (2006.01)

(52) U.S. Cl. ..... 166/377; 166/85.4; 294/215

(58) Field of Classification Search ..... 166/377, 166/85.4, 85.5, 85.1; 294/1.1, 94, 215; 411/400, 411/401

See application file for complete search history.

(56) References Cited

U.S. PATENT DOCUMENTS

| | | | | | |
|---|---|---|---|---|---|
| 1,872,498 | A | * | 8/1932 | Rasmussen et al. | 277/323 |
| 2,624,610 | A | * | 1/1953 | Murphy | 294/96 |
| 2,687,324 | A | * | 8/1954 | Grunsky et al. | 294/96 |
| 2,752,119 | A | * | 6/1956 | Allen et al. | 251/1.3 |
| 3,915,489 | A | * | 10/1975 | Murphy | 294/96 |
| 4,007,904 | A | * | 2/1977 | Jones | 251/1.2 |
| 4,017,115 | A | * | 4/1977 | Holt et al. | 294/89 |
| 4,253,638 | A | * | 3/1981 | Troxell, Jr. | 251/1.3 |
| 4,305,467 | A | * | 12/1981 | Villines | 166/385 |
| 4,486,005 | A | * | 12/1984 | Yaindl | 254/29 A |
| 5,655,745 | A | * | 8/1997 | Morrill | 251/1.3 |
| 5,816,565 | A | * | 10/1998 | McGuffin | 254/386 |
| 6,158,505 | A | * | 12/2000 | Araujo | 166/55 |
| 6,510,897 | B2 | * | 1/2003 | Hemphill | 166/373 |
| 6,712,147 | B2 | * | 3/2004 | Dallas | 166/379 |
| 7,051,990 | B2 | * | 5/2006 | Springett et al. | 251/1.1 |
| 7,121,348 | B2 | * | 10/2006 | Hemphill et al. | 166/373 |
| 7,762,599 | B2 | * | 7/2010 | Anda | 294/96 |
| 2006/0000992 | A1 | | 1/2006 | Springett et al. | |
| 2006/0243451 | A1 | | 11/2006 | Hemphill et al. | |
| 2010/0074674 | A1 | * | 3/2010 | Carmel | 403/185 |
| 2011/0030943 | A1 | * | 2/2011 | Le et al. | 166/85.4 |

OTHER PUBLICATIONS

Search Report and Written Opinion from corresponding PCT Application No. PCT/US2010/057727 dated Jun. 29, 2011.

* cited by examiner

*Primary Examiner* — Giovanna Wright
*Assistant Examiner* — Michael Wills, III
(74) *Attorney, Agent, or Firm* — Potomac Patent Group PLLC

(57) ABSTRACT

A lifting device configured to lift a bonnet of a blowout preventer. The lifting device includes two or more lifting pins, each lifting pin including, a body having an elongated shape and configured to enter through a hole in the bonnet; a shoulder connected to the body and having an external diameter larger than an external diameter of the body; and two or more threaded regions at different locations on the body and configured to receive threaded screws, each threaded region being formed in the body such that a coordinate of the threaded region in a given inertial system is substantially identical to a coordinate of a center of gravity of a corresponding bonnet in the same given inertial system when the lifting pin is inserted into a hole of the corresponding bonnet.

20 Claims, 9 Drawing Sheets

LIFTING DEVICE AND METHOD FOR LIFTING A BONNET

BACKGROUND

1. Technical Field

Embodiments of the subject matter disclosed herein generally relate to methods and systems and, more particularly, to mechanisms and techniques for lifting a bonnet of a blowout preventer.

2. Discussion of the Background

The existing technologies for extracting fossil fuels from offshore or onshore fields use, among other things, a blowout preventer (BOP) for preventing well blowouts. The BOP is conventionally implemented as a valve to prevent the release of pressure either in the annular space between the casing and the drill pipe or in the open hole (i.e., hole with no drill pipe) during drilling or completion operations. However, various components of the BOP need to be replaced from time to time. An example of a BOP 20 is shown in FIG. 1. The BOP 20 shown in FIG. 1 has, among other things, two ram blocks 22 that are supported by respective piston rods 24 and a corresponding locking mechanism 26. The locking mechanism 26 is configured to lock the rods 24 at desired positions. The two ram blocks 22 are configured to move along a direction parallel to a longitudinal axis of the piston rods 24. The ram blocks 22 may sever a drill line 28 or other tools that cross a vertical wellbore 30 of the BOP 20. However, after cutting the drill line 28 for a number of times, the ram blocks 22 and/or their respective cutting edges need to be inspected and sometimes reworked/replaced. Alternatively, if the ram blocks 22 are designed to seal the well and not to cut a tool, an elastomer provided on a face of the ram blocks 22 needs to be replaced after a certain number of closures of the BOP. For this reason, the BOP 20 of FIG. 1 is provided with a bonnet 32, for each ram block 22, which, for a particular BOP design, can be opened for providing access to the ram blocks. FIG. 2 shows the bonnet 32 having a hinge 34 that rotatably opens the bonnet 32.

Occasionally, the bonnet 32 itself needs to be serviced and then, the bonnet has to be removed from the BOP 20. Also, when the BOP 20 is assembled, the bonnet 32 that may be manufactured at another location needs to be brought next to the BOP 20 and lifted in place. Typically, multiple slings and "come alongs" are placed around the bonnet 32 and are attached to a crane/hoist for handling the bonnet. However, the weight of such a bonnet may reach the order of 3 tons, and thus, when lifting/handling the bonnet (for example, inserting or removing a pin 36 to a hinge 34 for attaching the bonnet to BOP 20) with this type of method, the bonnet can become unstable, making it difficult and unsafe to handle. Also, this procedure may present other risks as the BOP may be situated at a certain height above the floor of the manufacturing facility, or the BOP may be high (few meters) such that a fall of the bonnet from the crane may injure personnel working around or under the BOP.

Further, those skilled in the art would recognize that regular service of the BOP is required for changing the blades and/or elastomer attached to the ram blocks as discussed above. Thus, the BOP bonnets frequently need to be separated from the BOP body to expose and service the ram block. The operation of separating the bonnets from the BOP body is no easy task, and such an operation may require several hours even when utilizing multiple skilled technicians. However, the concern is the amount of down time for the entire rig, which cannot function without the BOP, as millions of dollars of drilling equipment may be idle during the BOP service operation. A solution to this problem is to design BOPS with bonnet-less "doors." However, these designs have other undesirable features.

Accordingly, it would be desirable to provide a tool that easily attaches to the bonnet of the BOP and facilitates the handling of the bonnet in a safe and efficient way.

SUMMARY

According to one exemplary embodiment, there is a lifting device configured to lift a bonnet of a blowout preventer. The lifting device includes two or more lifting pins. Each lifting pin includes a body having an elongated shape and configured to enter through a hole in the bonnet; a shoulder connected to the body and having an external diameter larger than an external diameter of the body; and two or more threaded regions at different locations on the body and configured to receive threaded screws. Each threaded region is formed in the body such that a coordinate of the threaded region in a given inertial system is substantially identical to a coordinate of a center of gravity of a corresponding bonnet in the same given inertial system when the lifting pin is inserted into a hole of the corresponding bonnet.

According to another exemplary embodiment, there is a method for lifting a bonnet of a blowout preventer with a lifting device. The method includes inserting two or more lifting pins to corresponding holes in the bonnet, each lifting pin including, a body having an elongated shape and a shoulder connected to the body and having an external diameter larger than an external diameter of the body; contacting the shoulder of the lifting pin with a shoulder of the corresponding hole in the bonnet; selecting a threaded region of two or more threaded regions formed at different locations in the body and configured to receive threaded screws, the selected threaded region being formed in the body such that a coordinate of the selected threaded region in a given inertial system is substantially identical to a coordinate of a center of gravity of the bonnet in the same given inertial system; and attaching a swivel hoist to the selected threaded region with a threaded screw.

According to still another exemplary embodiment, there is an adjustable lifting pin for lifting a bonnet of a blowout preventer. The lifting pin includes a body having an elongated shape and configured to enter through a hole in the bonnet, the body having an internal threaded region; a shoulder connected to the body and having an external diameter larger than an external diameter of the body; a pin having an external threaded region at a first end and configured to mate with the internal threaded region of the body, the pin also having a hole at a second end; and a swivel hoist attached to the second end of the pin and configured to be attached to a crane. The pin is configured to be adjustable to enter or exit the body such that a coordinate of the hole in the pin in a given inertial system is substantially identical to a coordinate of a center of gravity of the bonnet in the same given inertial system when the lifting pin is inserted into the hole.

According to further another exemplary embodiment, there is a method for lifting a bonnet of a blowout preventer with an adjustable lifting pin. The method includes inserting the adjustable lifting pin into a hole in the bonnet, the adjustable lifting pin including a body having an elongated shape and an internal threaded region; contacting a shoulder connected to the body and having an external diameter larger than an external diameter of the body with a shoulder of the hole in the bonnet; and screwing a pin into the body to adjust a length of the pin coming out of the body such that a coordinate of an internal threaded region of the pin in a given inertial system is substantially identical to a coordinate of a center of gravity of the bonnet in the same given inertial system. The pin has an external threaded region at a first end and configured to mate with the internal threaded region of the body, the pin also having the internal threaded region at the second end.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the exemplary embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to the terminology and structure of a bonnet of a BOP system. However, the embodiments to be discussed next are not limited to these systems, but may be applied to other systems that need to align a large and heavy part with another part.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

According to an exemplary embodiment, a lifting device (tool) may be attached to a bonnet of a BOP such that a coordinate of a center of gravity of the bonnet is substantially identical to a coordinate of a part of the lifting device. The lifting device allows an operator to move the bonnet while maintaining the bonnet in a balanced state, e.g., not tilting or oscillating.

Figure 1:
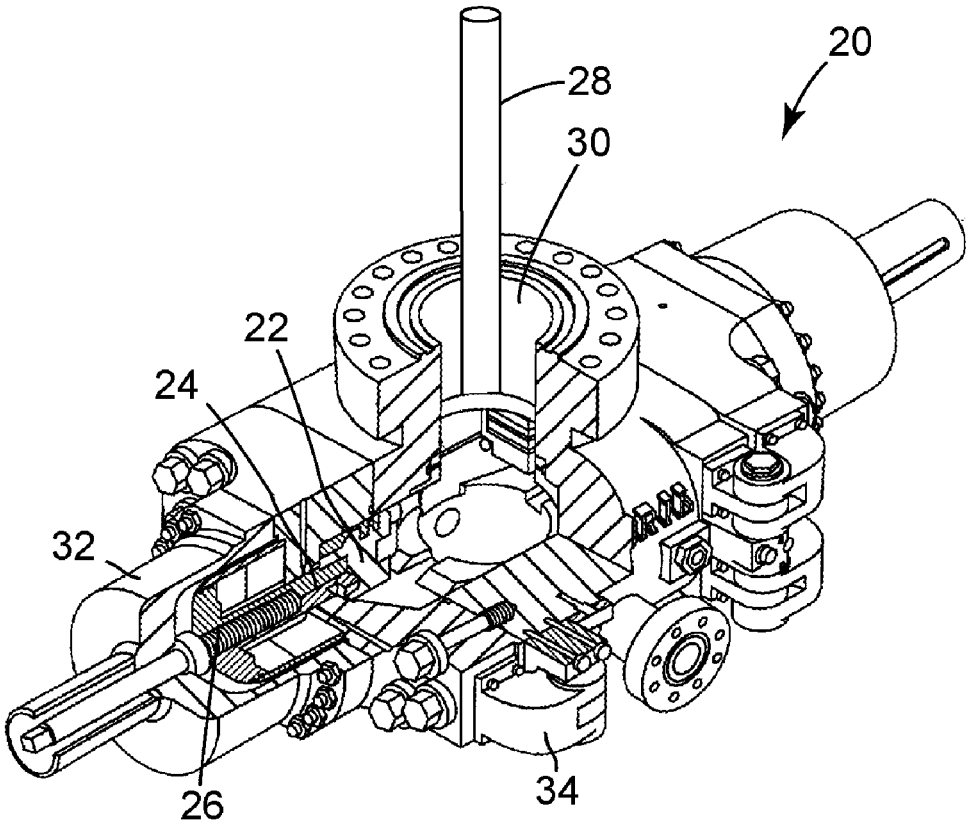
FIG. 1 Background Art
FIG. 1 is a schematic diagram of a conventional blowout preventer.
Figure 2:
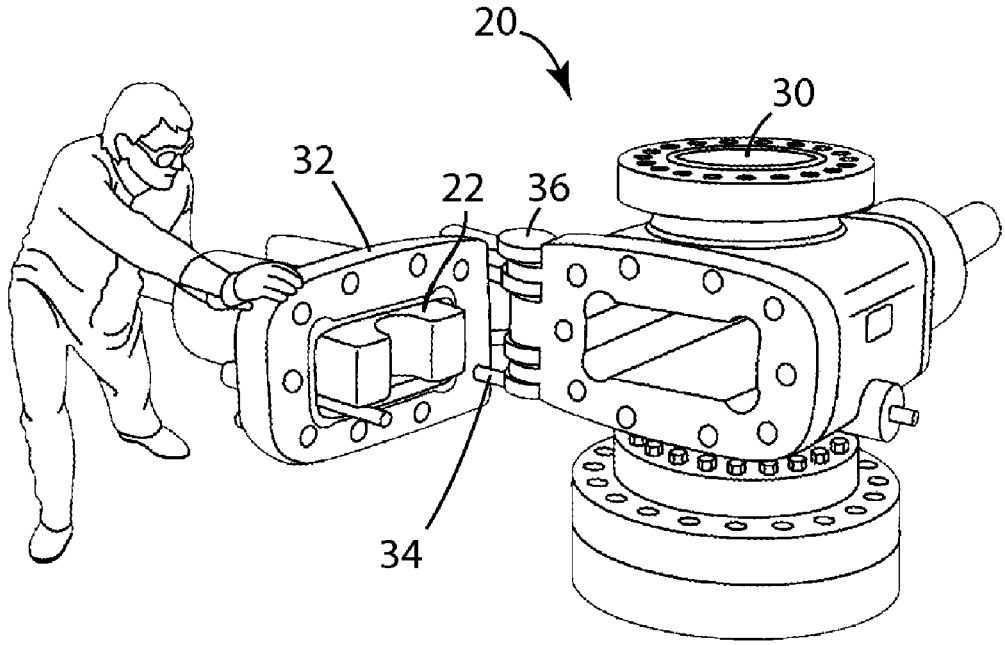
FIG. 2 Background Art
FIG. 2 is a schematic diagram of an opened blowout preventer.
Figure 3:
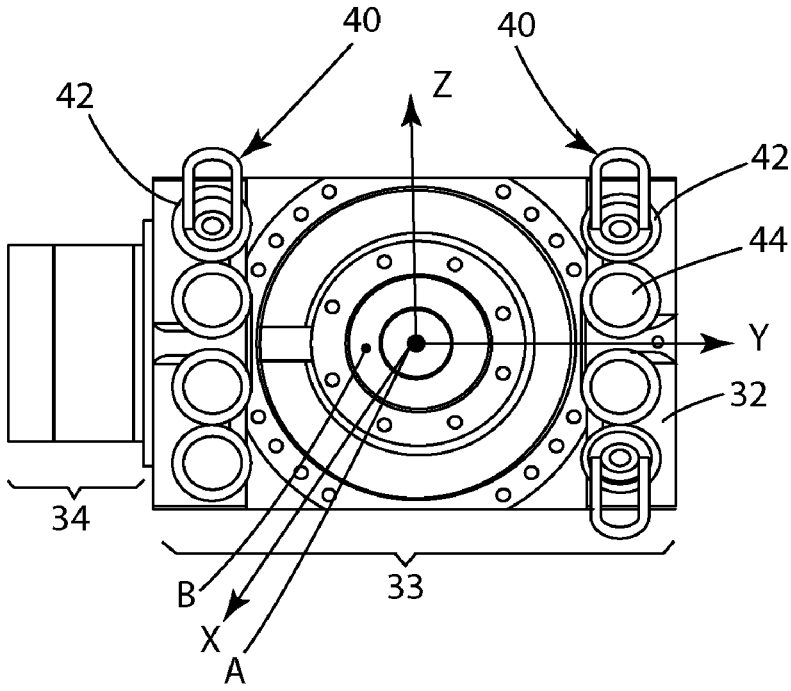
FIG. 3 is a schematic diagram of a bonnet with lifting pins according to an exemplary embodiment.
Figure 4:
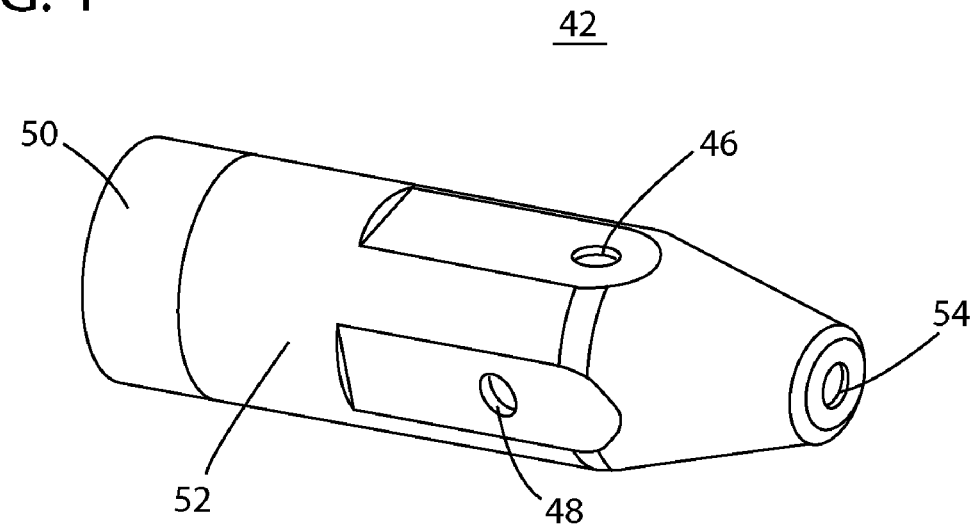
FIG. 4 is a schematic diagram of a lifting pin according to an exemplary embodiment.

According to an exemplary embodiment shown in FIG. 3, a lifting device 40 may include two or more lifting pins 42. Each lifting pin 42 may be attached to bonnet 32 at a predetermined hole 44, which may already exist in the bonnet 32. An overview of a lifting pin 42 is shown in FIG. 4. The bonnet 32 shown in FIG. 3 has a symmetrical part 33 and the hinge 34 shown in FIGS. 1 and 2. Supposing that only the symmetrical part 33 is part of the bonnet 32 (i.e., hinge 34 is not attached), a center of gravity of the symmetrical part 33 is shown by A. If the hinge 34 is considered, then the center of gravity of the bonnet 32 changes to B.

Figure 5:
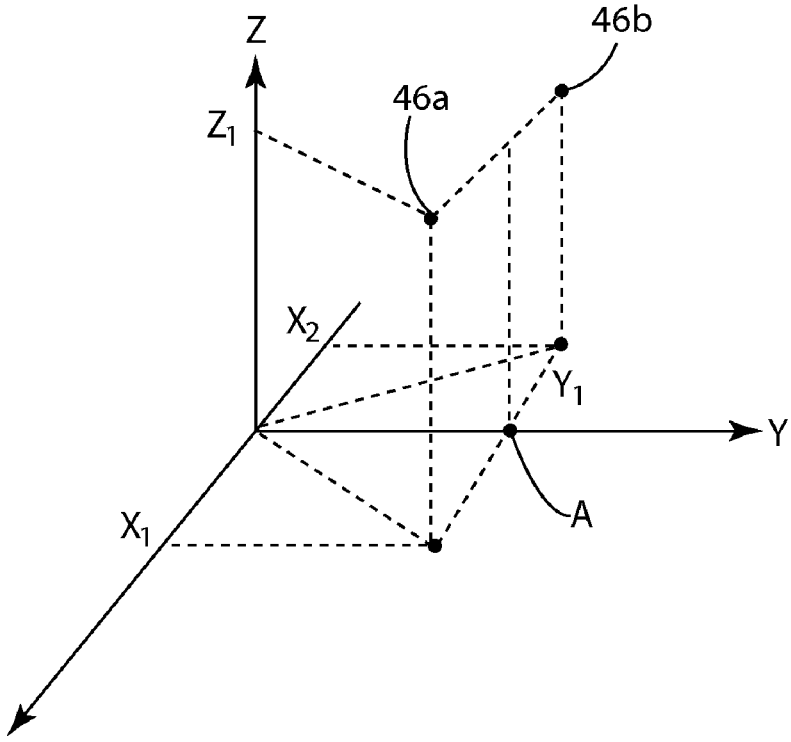
FIG. 5 is a graph indicating coordinates of a hole and a centre of gravity of a bonnet according to an exemplary embodiment.

Considering an inertial system of reference XYZ (illustrated in FIG. 3) that has the origin in point A, the lifting pins 42 are configured such that at least one hole 46 or 48 (see FIG. 4) formed in the lifting pins has one coordinate (X coordinate in this particular embodiment) substantially aligned (identical) to a coordinate of the center of gravity A of the bonnet 32. This concept is illustrated in more details in FIG. 5. For clarity, FIG. 5 shows the same system of reference XYZ with the origin different from A. FIG. 5 shows that point A is somewhere on the Y axis, and points 46*a* and 46*b* correspond to holes 46 in the two lifting points 42 shown in FIG. 3. It is noted that both points 46*a* and 46*b* and center of gravity A have substantially the same coordinate Y1 on the Y axis although the other coordinates on the X and Y axes are different. In one application, the coordinates of A are (0, y1, z0), the coordinates of 46*a* are (x1, y1, z1) and the coordinates of 46*b* are (x2, y1, z1), where the coordinates follow the convention (x, y, z). In the specific embodiment shown in FIG. 5, x2=−x1, i.e., points 46*a* and 46*b* are symmetric relative to Y axis or to the center of gravity A of the bonnet.

For aligning a hole in the lifting pin 42 with the center of gravity A of the bonnet 32, various approaches may be used as discussed next. According to an exemplary embodiment, lifting pin 42 is manufactured to have a shoulder 50 that has an external diameter larger than an external diameter of the body 52 of the lifting pin 42. As already discussed above, plural holes 46, 48 and 54 are formed in the body 52 of the lifting pin 42 as shown in FIG. 4. One such hole 54 may be formed at one end of the lifting pin 42, as shown in FIG. 4. While the shoulder 50 is manufactured to have a smooth outer surface, the holes are threaded to mate with a threaded screw (not shown). The plural holes 46, 48, 54 may include as many as can physically fit on to the body without affecting its structural integrity. The reason for having multiple holes is the following. Various BOPS have different bonnets. Some bonnets are large, some are small, and they have different weights and characteristics. For this reason, the center of gravity differs from one type of bonnet/BOP to another type of bonnet/BOP. The various holes 46, 48, 54 are such formed in the lifting pin 42 that a single lifting pin has a correct hole when inserted into any bonnet 32 such that the correct hole has one coordinate substantially identical to a coordinate of the center of gravity of the bonnet. In this way, the same lifting pin 42 may be used for different bonnets.

Further, most of or all the bonnets manufactured by a given manufacturer may have the holes 44 (see FIG. 3) having a same diameter. For this reason a single lifting pin 42 having a matching diameter may be used for all the bonnets manufactured by the respective manufacturer. If the lifting tool is intended to be used on bonnets manufactured by other manufacturers, the lifting pin has to be sized accordingly. According to an exemplary embodiment, the holes 44 are formed not in the body of the bonnet but rather on a flange part of the bonnet as more clearly shown in FIG. 8. Because the body of the bonnet has to withstand large pressures from inside (e.g., 2000 to 50000 psi), producing one or more holes into the body of the bonnet reduces the resistance of the bonnet. Thus, in this exemplary embodiment, the holes 44 are formed in a part of the bonnet that is not directly exposed to the pressures from within the BOP.

The multiple holes 46 and 48 may extend along a radial direction of the body 52, as shown in FIG. 4. Each hole may be identified by a legend/symbol encrusted in the body 52 for indicating the corresponding BOP for which it will align with the center of gravity of the bonnet. For example, with regard to FIG. 4, an inscription next to hole 46 may be used to indicate a first type of BOP while another inscription next to hole 48 may be used to indicate a second type of BOP.

Figure 6:
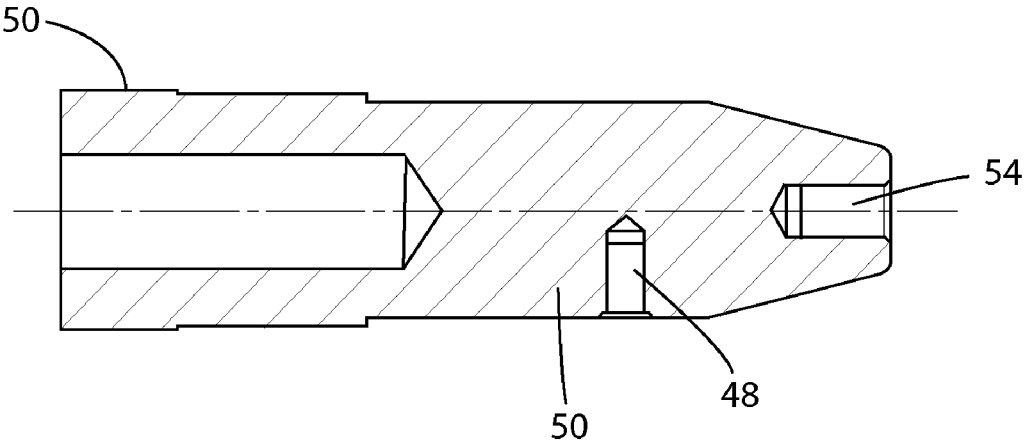
FIG. 6 is a schematic diagram of a cross section view of a lifting pin according to an exemplary embodiment.
Figure 7:
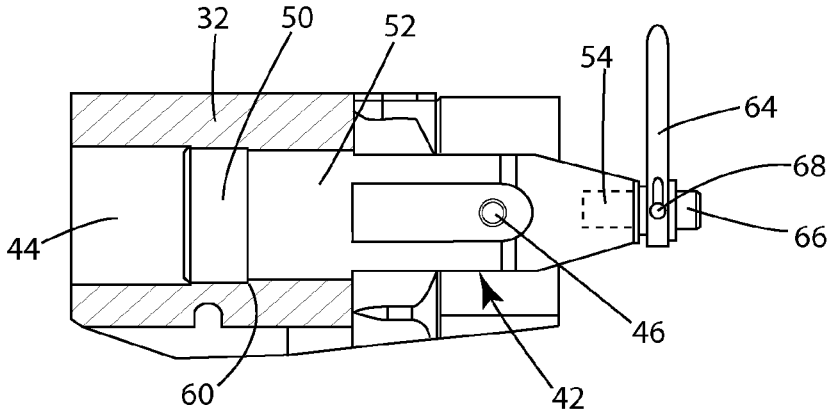
FIG. 7 is a schematic diagram of a cross section view of a lifting pin inserted in a bonnet according to an exemplary embodiment.

FIG. 6 shows a cross section of the lifting pin 42 shown in FIG. 4. Holes 48 and 54 are visible in this cross section together with shoulder 50. Shoulder 50 serves as a safety mechanism for preventing the lifting pin 42 from an undesired exit from the body of the bonnet 32. This is illustrated in FIG. 7 in which the bonnet 32 is shown with hole 44 and the lifting pin 42 is inserted into hole 44. It is noted that lifting pin 42 is inserted from left to right in FIG. 7 and a step shoulder 60 is formed inside hole 44 such that shoulder 50 of the lifting pin 42 is stopped by step shoulder 60 of hole 44.

FIG. 7 shows that a swivel hoist 64 is attached with a screw 66 to hole 54. The swivel hoist 64 may be connected by a link (not shown) to a crane (not shown) that will move the bonnet to a desired position. Swivel hoist 64 is attached to the screw 66 with a pin 68 such that the hoist 64 is free to rotate about pin 68. According to an exemplary embodiment, one coordinate of the pin 68 is substantially identical to a coordinate of the center of gravity of the bonnet 32.

As would be recognized by those skilled in the art, the above discussed elements are made of a strong material, like steel, such that the lifting pins, the hoist, and the holes in the bonnet can withstand the large weights of the bonnet.

Figure 8:
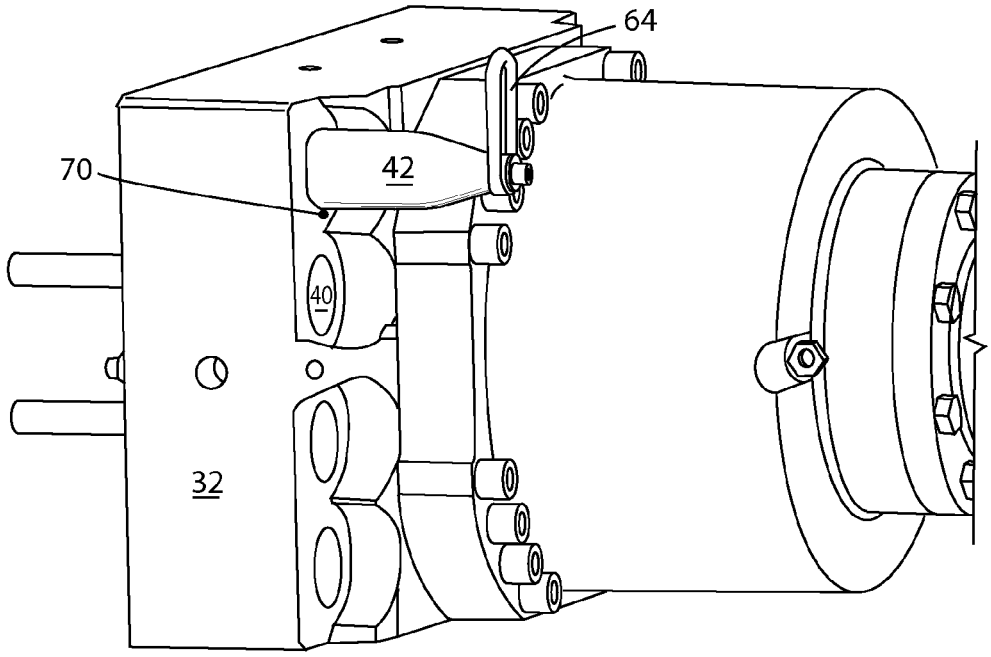
FIG. 8 is a schematic diagram of a lifting pin with a safety pin according to an exemplary embodiment.

FIG. 8 shows the bonnet 32 having the lifting pin 42 already installed. During operation, the BOP does not have the lifting pins 42 installed. When necessary to mount the bonnet to the BOP or to service the bonnet of BOP, the bonnet 32 is partially opened, after removing the bolts or other mechanisms that lock the bonnet to the body of the BOP 20, the lifting pins 42 are inserted from left to right in FIG. 8, i.e., from the body of the BOP 20 towards the bonnet 32, then the bonnet 32 is closed but not locked, the lifting pins 42 are connected to a crane and placed under tension, the pin 36 shown in FIG. 2 is removed and the bonnet 32 remains suspended by the lifting pins 42. According to another exemplary embodiment, the hinge 34 is removed from the bonnet 32 and then the bonnet 32 is suspended from the lifting pins 42. Because the holes in the lifting pins 42 to which the swivel hoist 64 is attached are aligned with one coordinate of the center of gravity of the bonnet 32, when the pin 36 and/or hinge 34 are removed, the bonnet 32 remains in a stationary state and does not oscillate or tilts out of control as would be happening if the center of gravity of the bonnet would not be aligned with the holes in the lifting pins or the swivel hoists as shown in FIG. 5.

This stationary state provides the technician of the BOP with more control of the movement of the bonnet while detached from the BOP, which reduces the risk of an unexpected movement of the bonnet that might injure the technicians working around the BOP.

Figure 9:
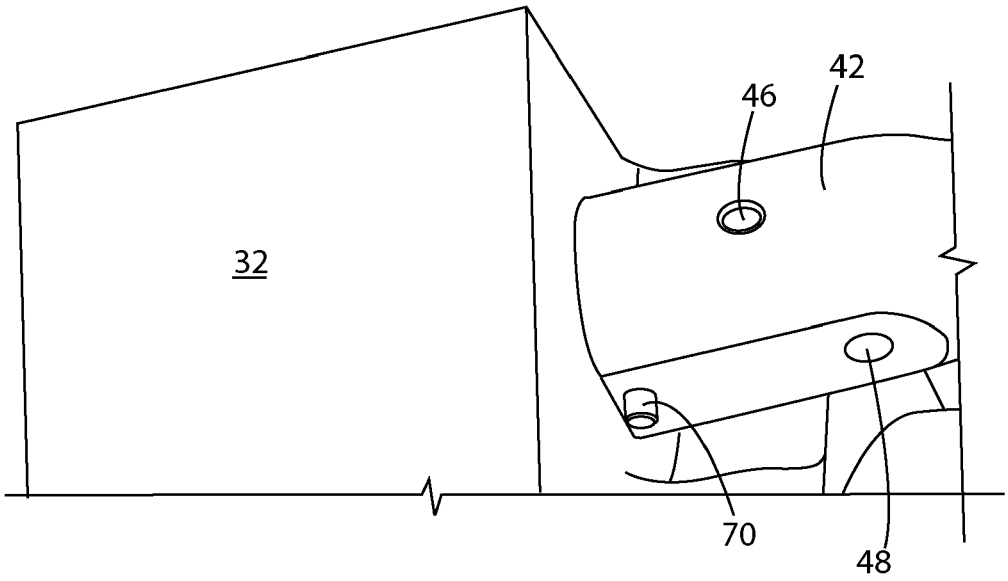
FIG. 9 is an external view of the lifting pin of FIG. 8 according to an exemplary embodiment.
Figure 10:
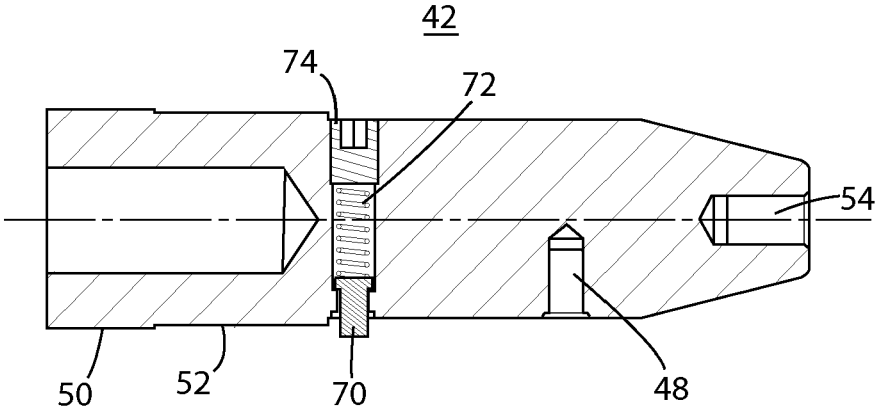
FIG. 10 is a schematic diagram of an adjustable lifting pin according to an exemplary embodiment.

According to an exemplary embodiment, a safety pin may be added to the lifting pin 42 as shown in FIG. 8. The safety pin 70 prevents the lifting pin 42 from moving from right to left in FIG. 8, i.e., from exiting the bonnet 32. In this way, the shoulder 50 and the safety pin 70 completely fix the lifting pin 42 relative to bonnet 32. FIG. 9 shows a full external view of the safety pin 70 when the lifting pin 42 is fully entered into the bonnet 32. FIG. 10 shows a cross section view of the lifting pin 42 and the safety pin 70. A spring 72 biases pin 70 towards outside the body 52 of the lifting pin 42 and a screw 74 fixes one end of the spring 72.

Figure 11:
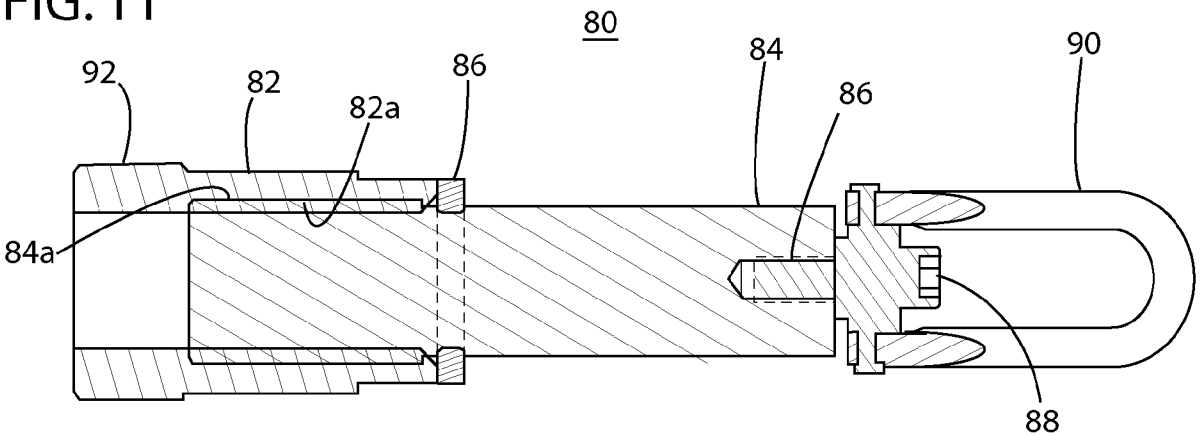
FIG. 11 is a cross sectional view of an adjustable lifting pin according to an exemplary embodiment.

According to another exemplary embodiment illustrated in FIG. 11, instead of providing a hole in the lifting pin for each type of BOP/bonnet, a new lifting pin 80 has a box 82 in which a pin 84 may be screwed in. A threaded surface 82*a* on box 82 mates a threaded surface 84*a* on the pin 84. A locknut 86 may be used to provide friction to keep in place the pin 84 relative to the box 82. For this exemplary embodiment, the pin 84 needs to have only one hole 86 to which a screw 88 is attached. Screw 88 fixes a swivel hoist 90 to the pin 84 and the swivel hoist 90 functions similar to the hoist 64 shown in FIGS. 7 and 8. A shoulder 92 similar to shoulder 50 in FIG. 4 may be provided to box 82. Box 82 and pin 84 function similar to the lifting pin 42 except that the plural holes are reduced to one hole as the pin 84 is adjustable relative to box 82. Further, box 82 and pin 84 are attached to the hole 40 in the bonnet 32 similar to the lifting pin 42.

Figure 12:
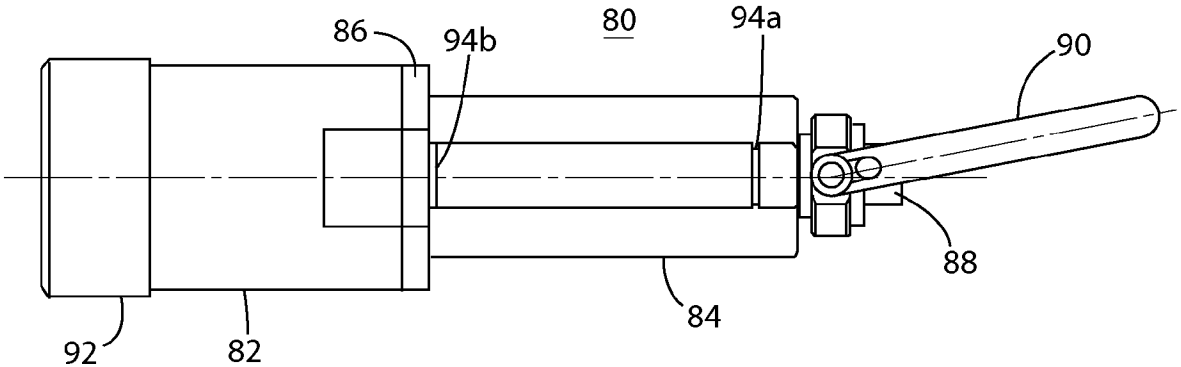
FIG. 12 is an overview of an adjustable lifting pin according to an exemplary embodiment.

As shown in FIG. 12, various marks 94*a*, 94*b* may be formed along the pin 84 and each mark may be correlated with a type of BOP/bonnet. In this way, assume that mark 94*b* corresponds to a 4 k BOP with multiple position lock (MPL). For this specific BOP/bonnet, the pin 84 has to be screwed into box 82 until mark 94*b* reaches a side of locknut 86 or a side of the box 84 if a lock nut is not provided. This alignment of the mark 94*b* ensures that a coordinate of the center of gravity of the bonnet 32 is substantially identical to a coordinate of the hole 86 and/or the swivel hoist 90. If the lifting pin 80 needs now to be used for a 4 k BOP with no MPL, then the pin 84 has to be further screwed into box 82 until mark 94*a* aligns with a side of the lock nut 86. In this way, a coordinate of the hole 86 or the swivel hoist 90 is aligned or substantially identical to a coordinate of the center of gravity of the new bonnet.

Figure 13:
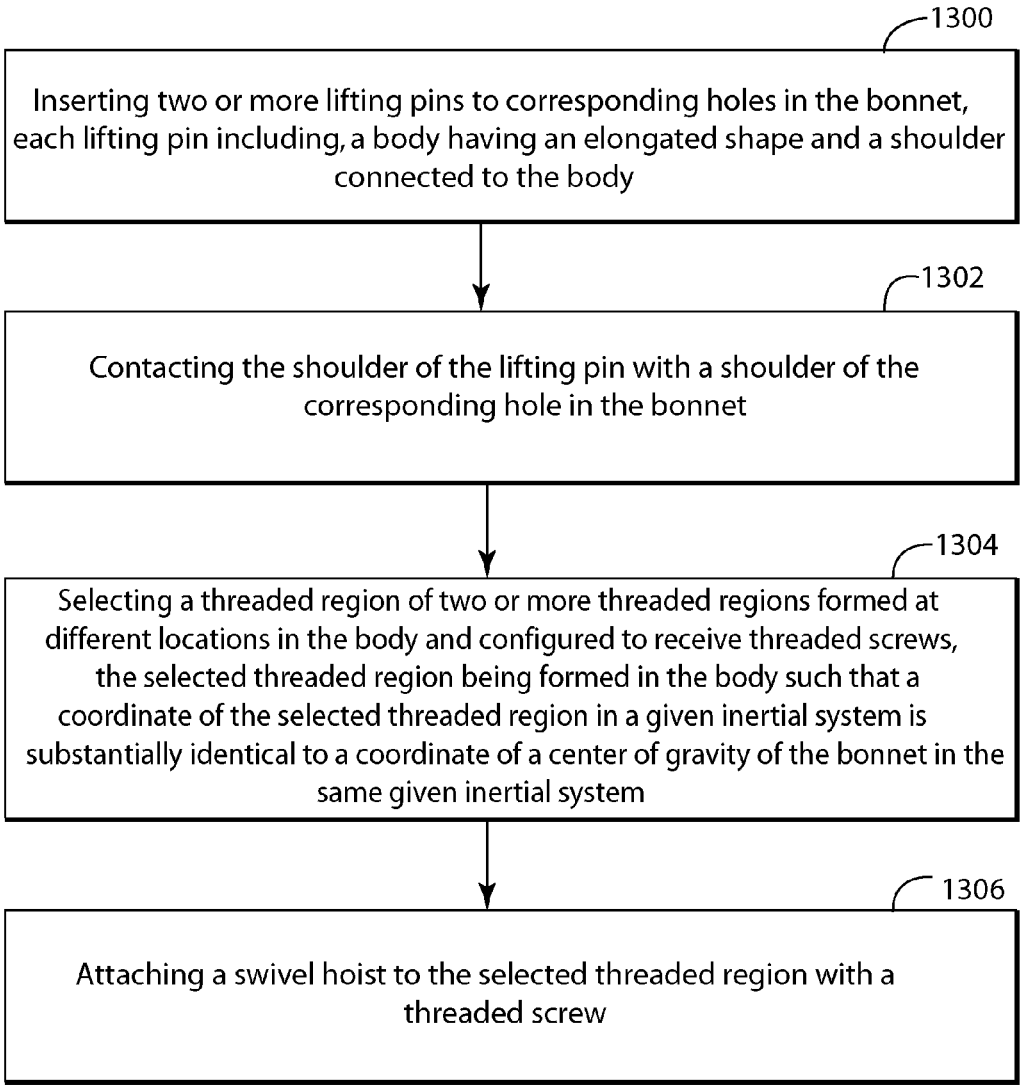
FIG. 13 is a flow chart of a method for lifting a bonnet with a lifting pin according to an exemplary embodiment.

According to an exemplary embodiment illustrated in FIG. 13, there is a method for lifting a bonnet of a blowout preventer with a lifting device. The method includes a step 1300 of inserting two or more lifting pins to corresponding holes in the bonnet, each lifting pin including, a body having an elongated shape and a shoulder connected to the body and having an external diameter larger than an external diameter of the body; a step 1302 of contacting the shoulder of the lifting pin with a shoulder of the corresponding hole in the bonnet; a step 1304 of selecting a threaded region of two or more threaded regions formed at different locations in the body and configured to receive threaded screws, the selected threaded region being formed in the body such that a coordinate of the selected threaded region in a given inertial system is substantially identical to a coordinate of a center of gravity of the bonnet in the same given inertial system; and a step 1306 of attaching a swivel hoist to the selected threaded region with a threaded screw.

Figure 14:
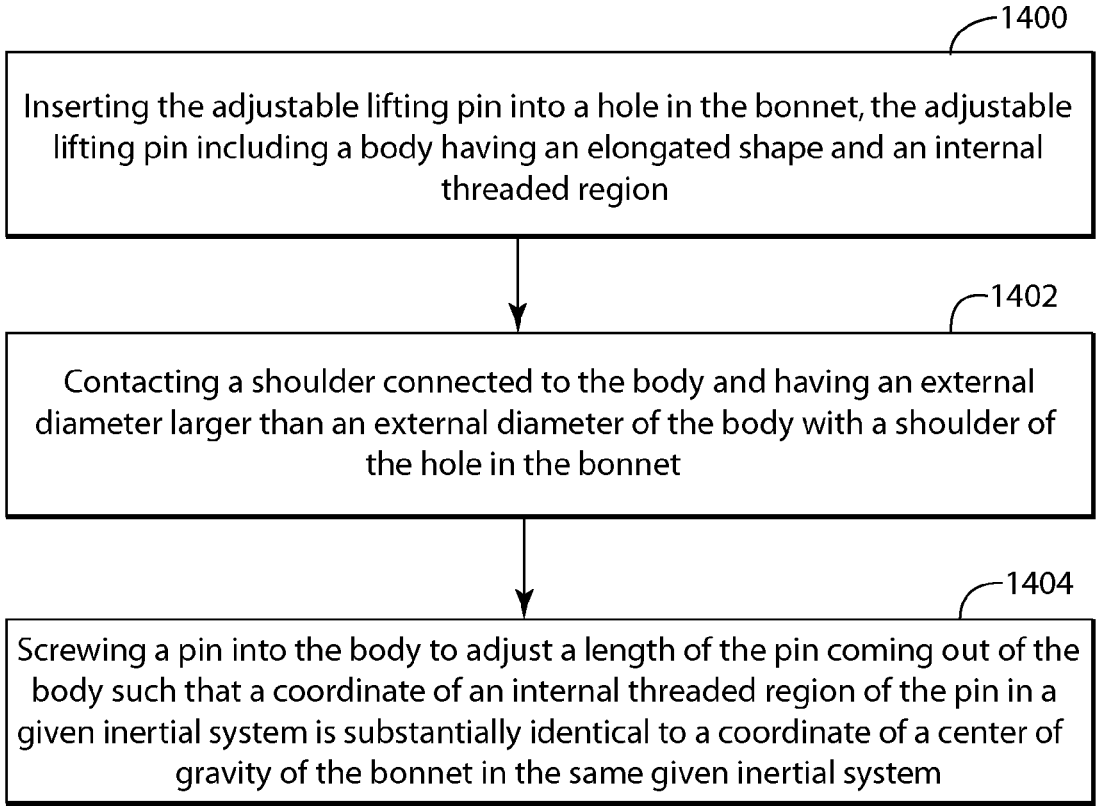
FIG. 14 is a flow chart of a method for lifting a bonnet with an adjustable lifting pin according to an exemplary embodiment.

According to another exemplary embodiment illustrated in FIG. 14, there is a method for lifting a bonnet of a blowout preventer with an adjustable lifting pin. The method includes a step 1400 of inserting the adjustable lifting pin into a hole in the bonnet, the adjustable lifting pin including a body having an elongated shape and an internal threaded region; a step 1402 of contacting a shoulder connected to the body and having an external diameter larger than an external diameter of the body with a shoulder of the hole in the bonnet; and a step 1404 of screwing a pin into the body to adjust a length of the pin coming out of the body such that a coordinate of an internal threaded region of the pin in a given inertial system is substantially identical to a coordinate of a center of gravity of the bonnet in the same given inertial system.

The disclosed exemplary embodiments provide a system and a method for lifting a bonnet of a blowout preventer. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A lifting device configured to lift a bonnet of a blowout preventer, the lifting device comprising:

two or more lifting pins, each lifting pin including, a body having an elongated shape and configured to enter through a hole in the bonnet;

a shoulder connected to the body and having an external diameter larger than an external diameter of the body; and two or more threaded regions at different locations on the body and configured to receive threaded screws, each threaded region being formed in the body such that a coordinate of the threaded region in a given inertial system is substantially identical to a coordinate of a center of gravity of a corresponding bonnet in the same given inertial system when the lifting pin is inserted into a hole of the corresponding bonnet.

2. The lifting device of claim 1, wherein each lifting pin is cylindrical.

3. The lifting device of claim 1, wherein each lifting pin includes an end threaded region extending along a longitudinal axis of the lifting pin and opposite to the shoulder.

4. The lifting device of claim 3, further comprising:

a swivel hoist attached with a screw to the end threaded region and configured to be attached to a crane for moving the bonnet.

5. The lifting device of claim 1, further comprising:

a safety pin attached to at least one of the two or more lifting pins, the safety pin extending partially inside the body of the at least one lifting pin in a radial direction.

6. The lifting device of claim 5, further comprising:

a spring completely provided inside the body and configured to bias the safety pin; and a set screw configured to be screwed into the body to contact the spring and fix an end of the spring.

7. A method for lifting a bonnet of a blowout preventer with a lifting device, the method comprising:

inserting two or more lifting pins to corresponding holes in the bonnet, each lifting pin including, a body having an elongated shape and a shoulder connected to the body and having an external diameter larger than an external diameter of the body;

contacting the shoulder of the lifting pin with a shoulder of the corresponding hole in the bonnet;

selecting a threaded region of two or more threaded regions formed at different locations in the body and configured to receive threaded screws, the selected threaded region being formed in the body such that a coordinate of the selected threaded region in a given inertial system is substantially identical to a coordinate of a center of gravity of the bonnet in the same given inertial system; and attaching a swivel hoist to the selected threaded region with a threaded screw.

8. The method of claim 7, further comprising:

unlocking and opening the bonnet prior to inserting the lifting pins;

closing the bonnet after the insertion of the lifting pins; and applying a tension to the lifting pins with a crane.

9. The method of claim 8, further comprising:

removing a pin holding a hinge of the bonnet attached to the blowout preventer; and removing the bonnet from the blowout preventer.

10. The method of claim 9, further comprising:

moving the bonnet while the bonnet does not experience sudden movements due to a misalignment of the coordinate of the center of gravity with the coordinate of the threaded region.

11. The method of claim 9, further comprising:

inserting the two or more lifting pins into the bonnet until corresponding safety pins attached to two or more lifting pins exit the bonnet.

12. An adjustable lifting pin for lifting a bonnet of a blowout preventer, the lifting pin comprising:

a body having an elongated shape and configured to enter through a hole in the bonnet, the body having an internal threaded region;

a shoulder connected to the body and having an external diameter larger than an external diameter of the body;

a pin having an external threaded region at a first end and configured to mate with the internal threaded region of the body, the pin also having a hole at a second end; and a swivel hoist attached to the second end of the pin and configured to be attached to a crane, wherein the pin is configured to be adjustable to enter or exit the body such that a coordinate of the hole in the pin in a given inertial system is substantially identical to a coordinate of a center of gravity of the bonnet in the same given inertial system when the lifting pin is inserted into the hole.

13. The adjustable lifting pin of claim 12, further comprising:

a lock nut attached to the pin and configured to maintain in position the pin relative to the body during operation.

14. The adjustable lifting pin of claim 12, further comprising:

plural marks formed on an exterior surface of the pin, each mark being indicative of a type of bonnet.

15. The adjustable lifting pin of claim 12, wherein the shoulder is cylindrical and has a smooth external surface.

16. The adjustable lifting pin of claim 12, wherein the hole has an internal threaded region extending along a longitudinal axis of the lifting pin and opposite to the shoulder.

17. A method for lifting a bonnet of a blowout preventer with an adjustable lifting pin, the method comprising:

inserting the adjustable lifting pin into a hole in the bonnet, the adjustable lifting pin including a body having an elongated shape and an internal threaded region;

contacting a shoulder connected to the body and having an external diameter larger than an external diameter of the body with a shoulder of the hole in the bonnet; and screwing a pin into the body to adjust a length of the pin coming out of the body such that a coordinate of an internal threaded region of the pin in a given inertial system is substantially identical to a coordinate of a center of gravity of the bonnet in the same given inertial system, the pin having an external threaded region at a first end and configured to mate with the internal threaded region of the body, the pin also having the internal threaded region at the second end.

18. The method of claim 17, further comprising:

unlocking and opening the bonnet prior to inserting the lifting pin;

closing the bonnet after the insertion of the lifting pin; and applying a tension to the lifting pin with a crane.

19. The method of claim 18, further comprising:

removing a pin holding a hinge of the bonnet attached to the blowout preventer; and removing the bonnet from the blowout preventer.

20. The method of claim 19, further comprising:

moving the bonnet while the bonnet does not experience sudden movements due to a misalignment of the coordinate of the center of gravity with the coordinate of the internal threaded region.

* * * * *